US007657982B2

(12) United States Patent
Münstermann et al.

(10) Patent No.: US 7,657,982 B2
(45) Date of Patent: Feb. 9, 2010

(54) SUCTION DEVICE FOR LIQUIDS, IN PARTICULAR HYDROENTANGLING MACHINES

(75) Inventors: Ullrich Münstermann, Egelsbach (DE); Roland Schweizer, Leonberg (DE)

(73) Assignee: Fleissner GmbH, Egelsbach (DE)

( * ) Notice: Subject to any disclaimer, the term of this patent is extended or adjusted under 35 U.S.C. 154(b) by 235 days.

(21) Appl. No.: 10/583,488

(22) PCT Filed: Nov. 4, 2004

(86) PCT No.: PCT/EP2004/052809

§ 371 (c)(1),
(2), (4) Date: Apr. 2, 2008

(87) PCT Pub. No.: WO2005/059217

PCT Pub. Date: Jun. 30, 2005

(65) Prior Publication Data

US 2008/0168636 A1 Jul. 17, 2008

(30) Foreign Application Priority Data

Dec. 18, 2003 (DE) ..... 103 59 916
Jun. 25, 2004 (DE) ..... 10 2004 030 918

(51) Int. Cl.
*D04H 1/46* (2006.01)

(52) U.S. Cl. ..... 28/104

(58) Field of Classification Search ..... 28/104, 28/105, 106, 167; 15/309.1, 306.1, 309.2; 68/200, 201, 204, 205 R; 8/147, 148, 151; 239/554, 556, 557, 568

See application file for complete search history.

(56) References Cited

U.S. PATENT DOCUMENTS

| | | | | |
|---|---|---|---|---|
| 3,992,746 | A | 11/1976 | Rhodes | 15/307 |
| 4,166,368 | A * | 9/1979 | Beninca' et al. | 68/20 |
| 4,197,609 | A * | 4/1980 | Fuhring | 15/309.1 |
| 6,324,738 | B1 * | 12/2001 | Fleissner | 28/104 |
| 6,338,187 | B1 * | 1/2002 | Fleissner | 28/106 |
| 6,412,140 | B1 | 7/2002 | Fleissner | 15/309 |
| 6,957,474 | B2 * | 10/2005 | Fleissner | 28/104 |
| 7,350,279 | B2 * | 4/2008 | Noelle | 28/104 |
| 2003/0182780 | A1 | 10/2003 | Fleissner | 28/104 |
| 2004/0140043 | A1 | 7/2004 | Cavalotti et al. | 156/123 |
| 2005/0155200 | A1 * | 7/2005 | Fleissner | 28/104 |

FOREIGN PATENT DOCUMENTS

| | | |
|---|---|---|
| DE | 3741658 | 6/1989 |
| EP | 0853156 | 7/1998 |
| EP | 1036871 | 9/2000 |

* cited by examiner

*Primary Examiner*—Amy B Vanatta
(74) *Attorney, Agent, or Firm*—Andrew Wilford

(57) ABSTRACT

The invention relates to a suction device for liquids in hydroentangling machines, in which more than one water bar, which generate jets of liquid, are allocated to the exterior of the suction device. The suction device consists of a suction tube comprising one or more axial suction openings for each water bar, said openings being located along the working length of the tube. The liquid is sucked from the allocated water bar through said openings as a result of the negative pressure that is created in the tube. According to the invention, the suction openings that extend over the entire working width are configured to be sealed in relation to each respectively allocated water bar.

15 Claims, 6 Drawing Sheets

Fig. 2
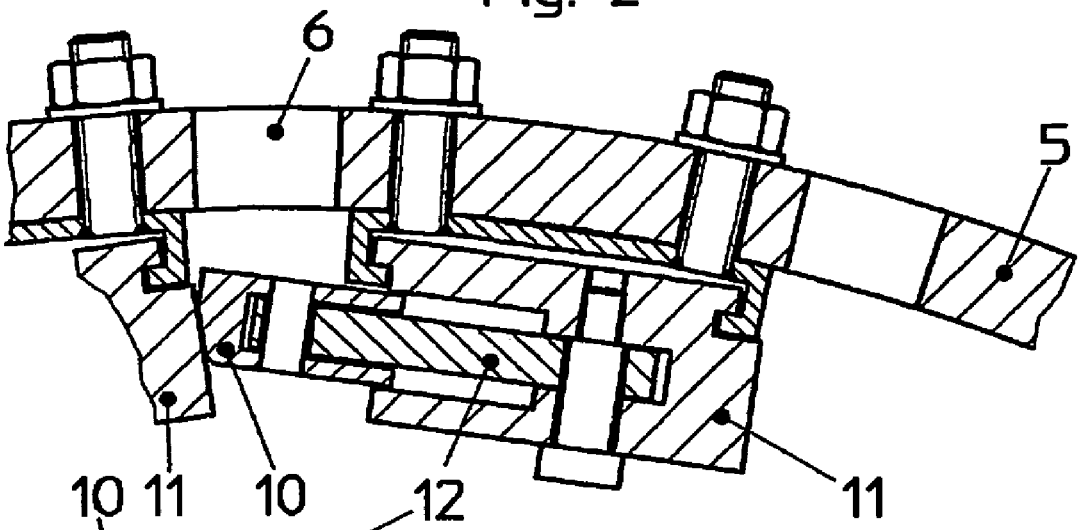
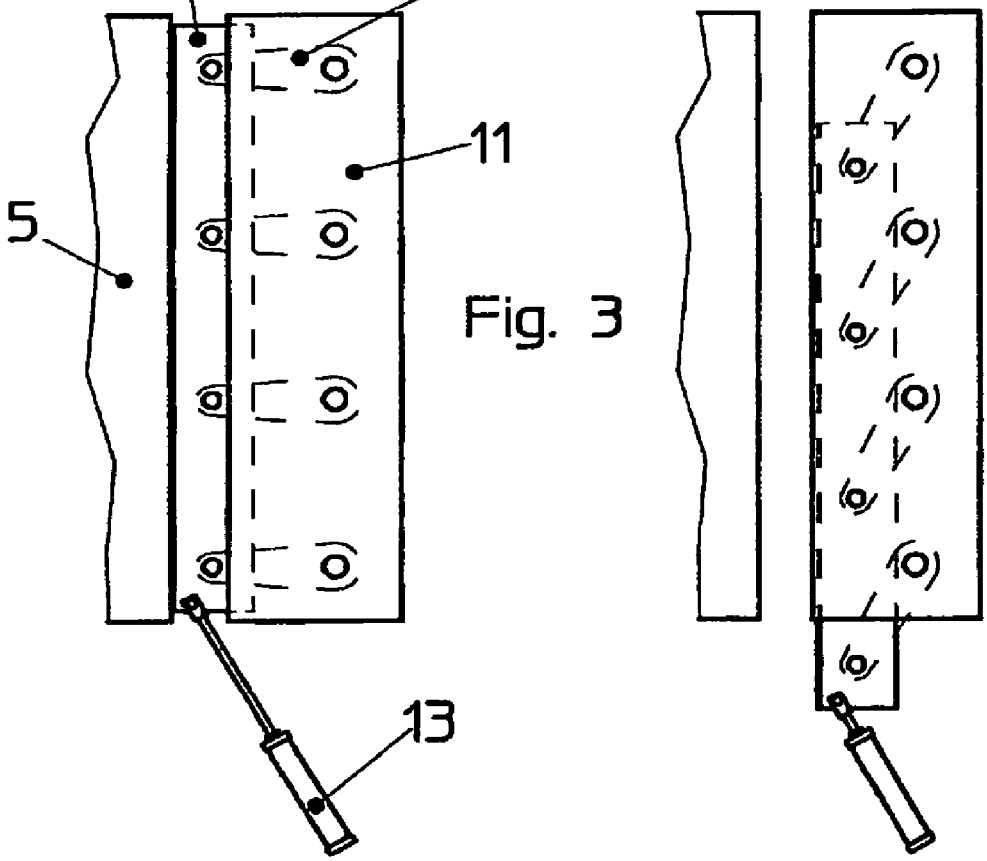
Fig. 3

SUCTION DEVICE FOR LIQUIDS, IN PARTICULAR HYDROENTANGLING MACHINES

CROSS REFERENCE TO RELATED APPLICATIONS

This application is the U.S. national phase of PCT application PCT/EP2004/052809, filed 4 Nov. 2004, published 30 Jun. 2005 as WO2005/059217, and claiming the priority of German patent application 10359916.9 itself filed 18 Dec. 2003 and German patent application 102004030918.3 itself filed 25 Jun. 2004, whose entire disclosures are herewith incorporated by reference.

FIELD OF THE INVENTION

The invention pertains to a suction device for liquids, in particular, in hydroentangling machines in which more than one water bar for generating jets of liquid are provided and the suction device consists of a suction tube with one or more axially extending suction openings for each water bar that extend over the working length of the tube. The liquid is sucked from the respective water bar through the respective suction opening as a result of negative pressure in the tube. A device of this type is known from EP-A-1 059 377 (U.S. Pat. No. 6,412,140) or WO 01/79598 (U.S. Pat. No. 6,957,474).

BACKGROUND OF THE INVENTION

It is common practice to provide several water bars in an entangling drum with internally arranged suction tube, a suction slot in the suction tube that may also consist of several suction openings each being aligned with a respective water bar. The suction tube is subjected to a negative pressure in order to carry off the sprayed-on liquid. The negative pressure acts upon all suction slots of the suction tube. This means that a suction slot whose respective water bar is switched off, is also subjected to the negative pressure. This leads to avoidable pressure losses.

OBJECT OF THE INVENTION

The invention aims to develop a device that makes it possible to prevent the energy losses caused by existing water bars while they are switched off.

SUMMARY OF THE INVENTION

Based on a device of the above-cited type, this objective is attained in that the suction openings extending over the entire working width are configured such that they can be sealed relative to the respectively allocated water bar. The sealing mechanism can be realized in different ways.

BRIEF DESCRIPTION OF THE DRAWING

Several devices according to the invention are illustrated in the figures in an exemplary fashion. The figures show in:

FIG. 2, a cross section through a shutter on the inner side of the suction tube;

FIG. 3, a top view of the shutter according to FIG. 2 in two different positions;

SPECIFIC DESCRIPTION

Figure 1:
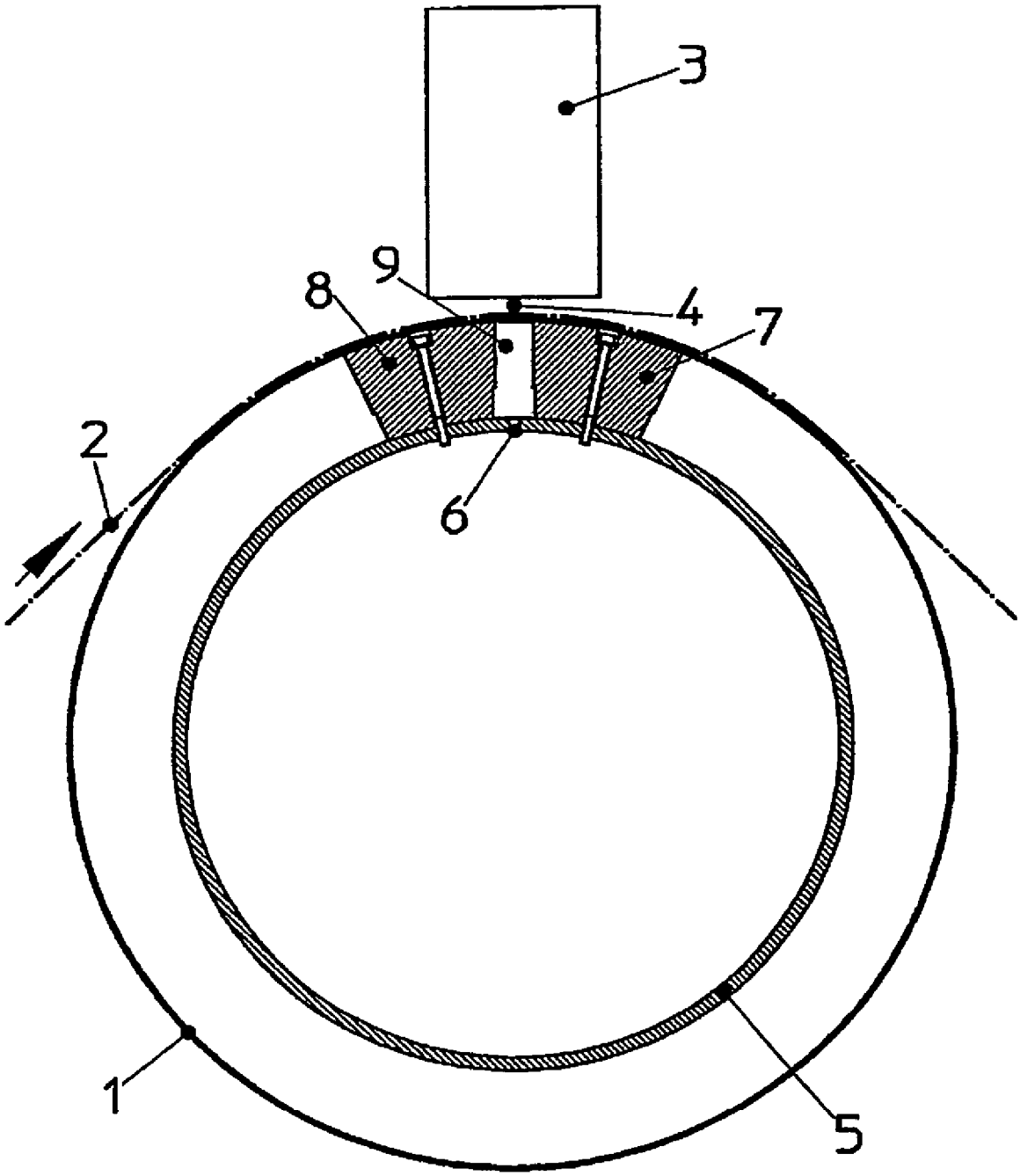
FIG. 1, a cross section through a drum for hydroentangling a web of endless fabric that only features one jet bar.

The suction device consists of a rotatably supported drum 1 that is permeable to liquids. The material 2 to be entangled lies on this drum 1. Only one water bar 3 is arranged above the drum 1. Water jets 4 are ejected from said water bar 3 under high pressure and impinge on the material 2. Several such water bars 3 could be arranged around the drum 1. The sprayed-on water needs to be removed by suction immediately thereafter underneath the material 2. For this purpose, a suction tube 5 is stationarily supported centrally within the drum 1. The wall of this suction tube is formed with suction bores 6 that are aligned in a row along an axis of the water bar 3. Sliding strips 7, 8 for determining the width of the suction slot 9 are stationarily arranged radially outside the tube 5 parallel to the axis on the left side as well as the right side of these bores 6.

Figure 7A:
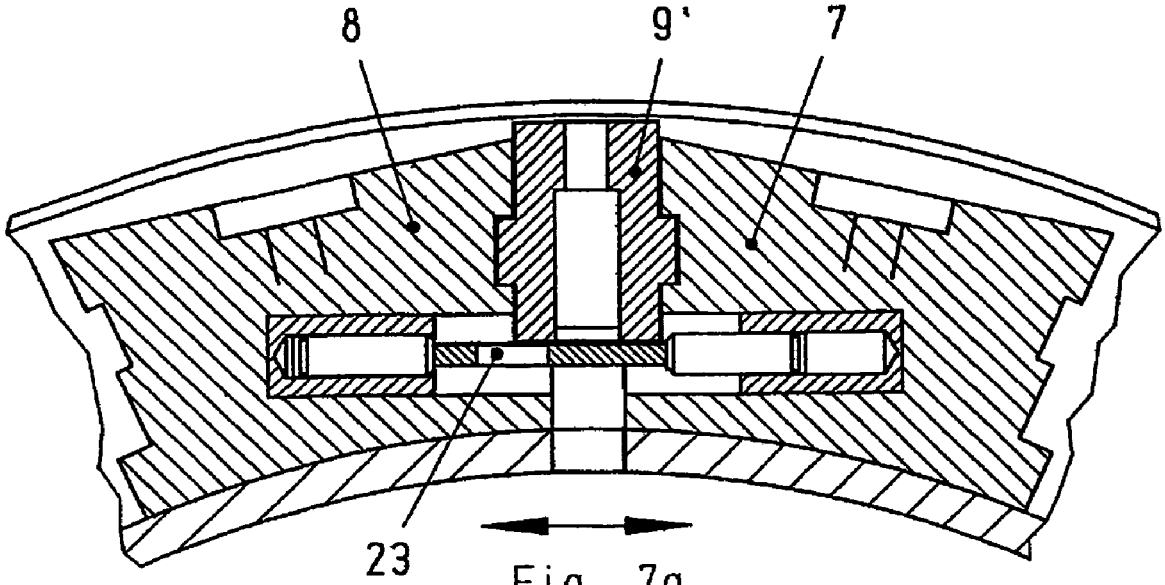

The suction slot 9 should be realized such that it can be quickly sealed. The solution according to above-cited EP-A-1 059 377 features an exchangeable cleaning strip 9' according to FIG. 7*a*, in which the suction openings are formed about centrally. In this case, the suction slot can be sealed by attaching a strip that lacks the suction openings, i.e., a massive shoe. However, this seal can only be produced while the machine is at a standstill.

FIG. 2 shows a suction tube 5 whose suction openings 6 can be covered by a laterally displaceable shutter 10 arranged on the inner side of the tube 5. This shutter 10 is detachably held on the suction tube 5 by means of a bearing arrangement 11. The shutter 10 is supported for pivoting by a plurality of articulated arms 12 according to FIG. 3 such that the shutter 10 is moved toward the supporting block 11 on the other side of the suction slot 6 when the articulated arms 12 are pivoted. This means that the suction slot 6 is sealed by the shutter 10. The actuation of the shutter movement is achieved with a pressure cylinder 13.

Figure 4:
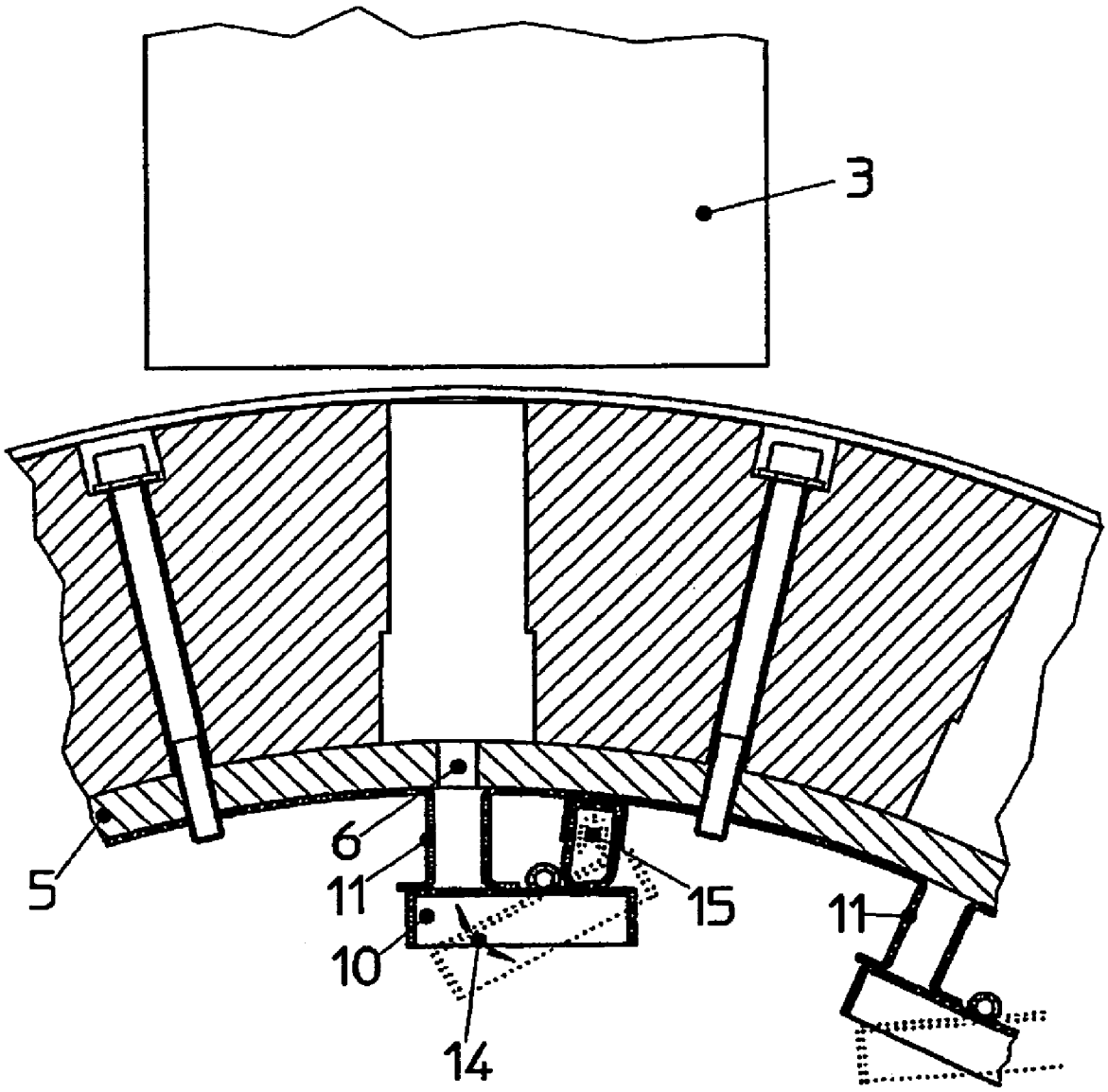
FIG. 4, a cross section through another construction of a shutter.

In the solution according to FIG. 4, the bearing arrangement 11 supports a shutter 10 that can also be pivoted upward in the direction of the double arrow 14 and seals the suction slot 6 with a mating profile 11. The actuation of the shutter 10 can be realized with a pressure hose 15 that is held in the bearing arrangement 11 over the length of the suction slot 5. When this pressure hose is filled with compressed air, it expands and moves the shutter 10 upward with the free end in order to seal the suction slot 6.

Figure 5A:
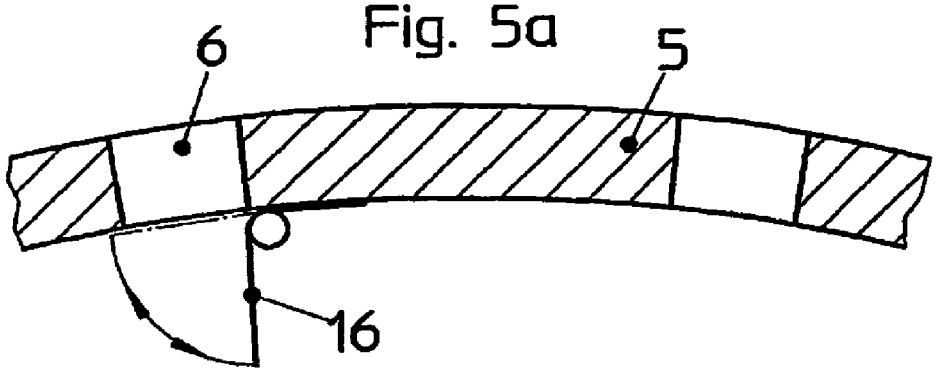
FIGS. 5*a-c*, other optional solutions that are illustrated in schematic cross sections.
Figure 5B:
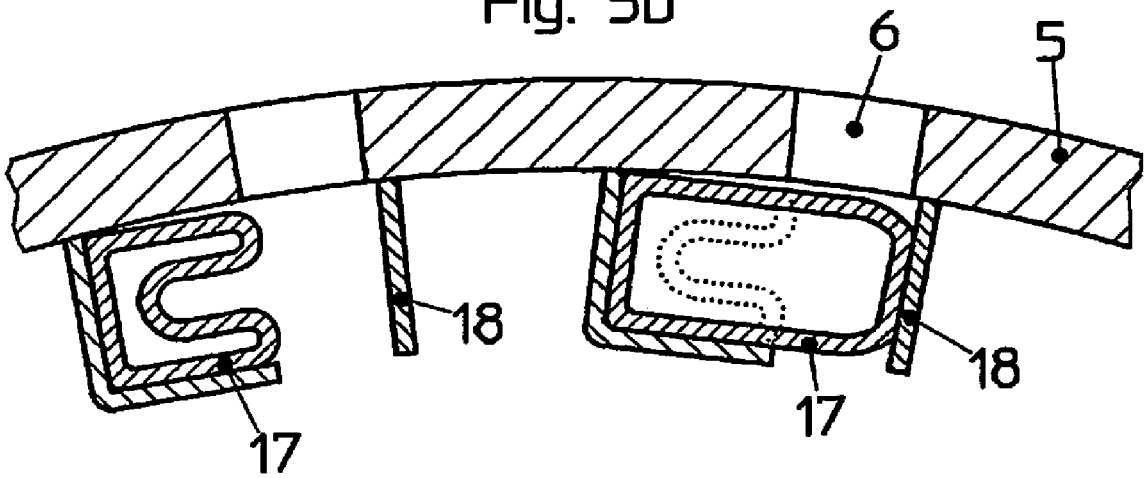
Figure 5C:
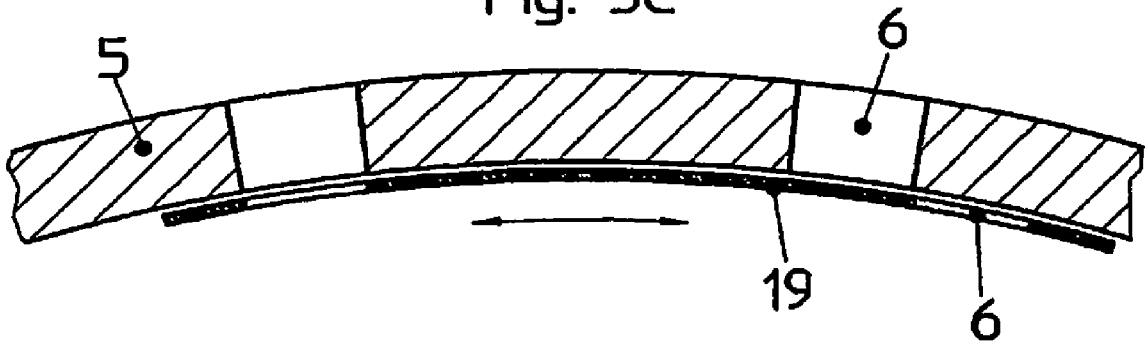

In a simpler solution that is schematically illustrated in FIG. 5*a*, merely a longitudinal shutter 16 is provided on the inner side of the suction tube such that it can be moved upward in order to seal the opening 6 by means of a not-shown mechanism. FIG. 5*b* shows a hose 17 that can be pressurized and is longitudinally arranged on one side of the slot 6. This hose is moved against a supporting wall 18 on the other side of the slot 6 after it is inflated with compressed air. However, a suction slot may also be sealed by coaxially arranging a sealing tube 19 on the inner side of the suction tube 5 such that it can be turned relative to the suction tube 5. The sealing tube 19 is formed with through-openings 6 that correspond to the arrangement of the suction slots 6 and cover the corresponding suction slot 6 after being turned accordingly.

Figure 6A:
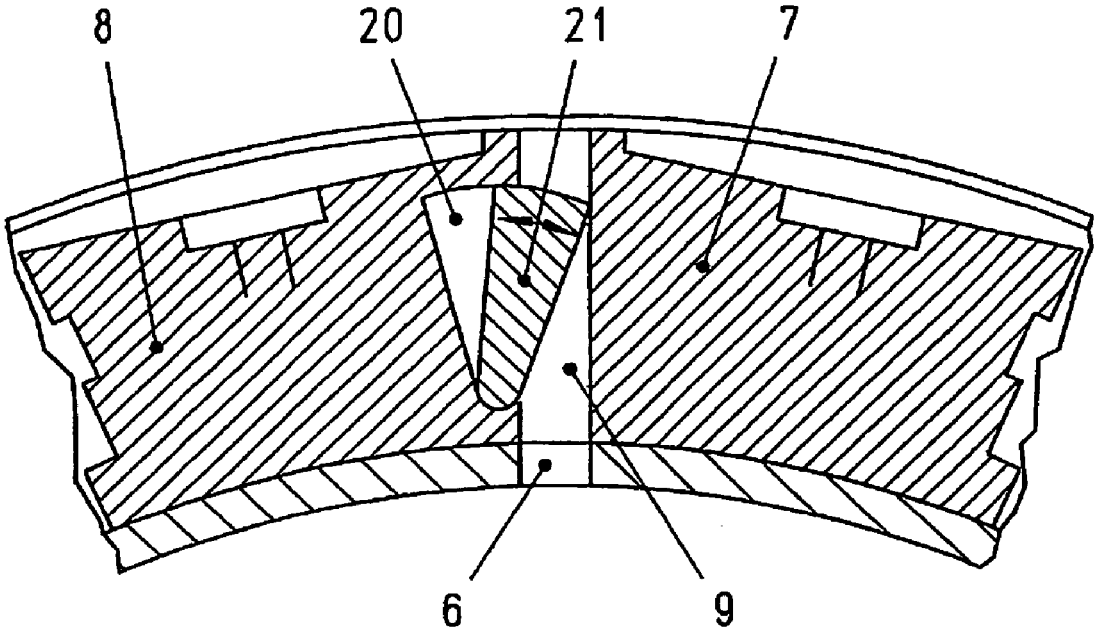
FIGS. 6*a-b*, a shutter that can be pivoted along the axis of the suction slot, and FIG. 7*a-b*, a sealing rail that can be displaced laterally of the suction slot and extends over the length of the suction slot.
Figure 6B:
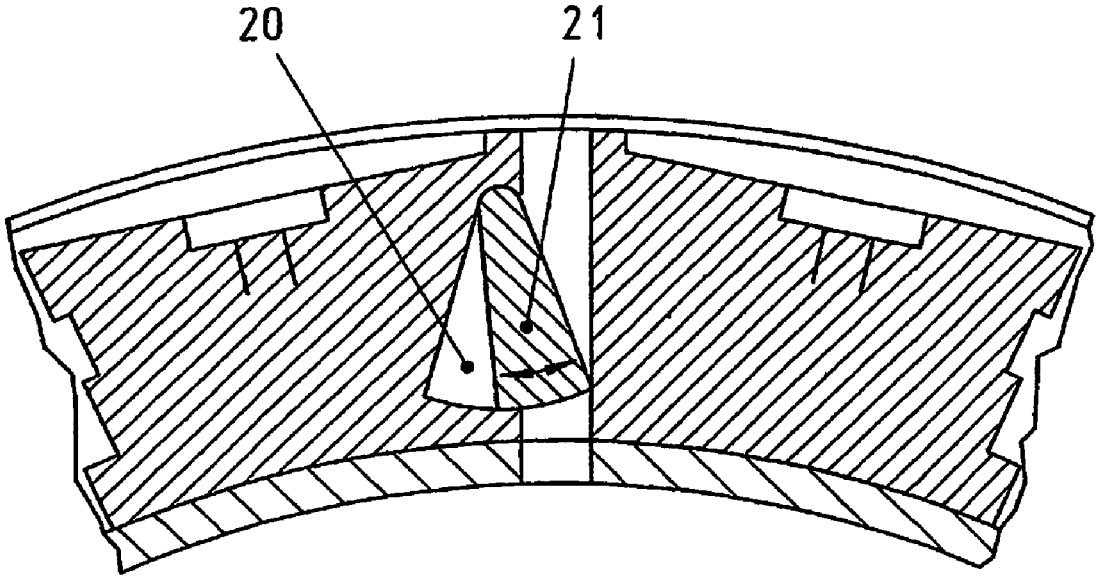
Figure 7B:
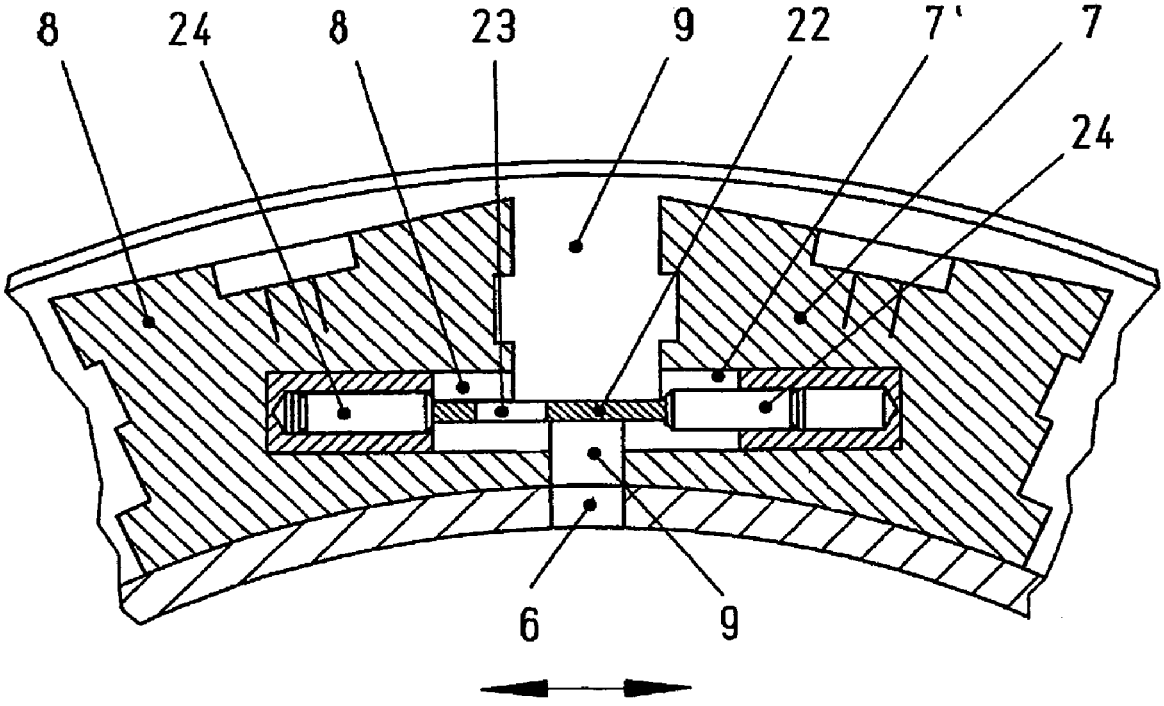

FIGS. 6 and 7 show optional solutions that are arranged in the lateral walls 7, 8 of the suction slot 9. According to FIG. 6, a recess 20 for accommodating a pivoting mechanism is arranged in one of the walls 8. If applicable, this lever 21 is realized in a conical fashion and supported along the suction slot. This lever can be pivoted along the axis of the suction slot. This can be achieved with the axially inner axis shown in FIG. 6*a* or the axially outer axis shown in FIG. 6*b*. The pivoting movement could be achieved electrically, but it would also be conceivable to realize other operating modes.

FIG. 7 shows a sliding mechanism. A sealing rail 22 is arranged perpendicular to the suction slot 9 radially inward of the cleaning strip 9', namely in recesses 7', 8' formed in the walls 7, 9 on both sides. This sealing rail 22 features a longitudinal through-slot 23 for the liquid removed by suction. Several piston units 24 are longitudinally spaced along the sealing rail 22 to both sides thereof and are preferably driven hydraulically in order to displace the rail 22 in the recesses 7', 8'. In the position shown, the suction slot 9 is sealed by the rail 22. The function of the suction device is ensured by laterally displacing the rail 22 toward the right such that the through-slot is positioned congruently with the suction slot 9.

The invention claimed is:

1. A hydroentangling machine comprising:

a liquid-permeable and hollow drum extending along an axis;

a plurality of stationary and axially extending water bars radially juxtaposed with and angularly spaced around the drum, each bar projecting at least one liquid jet radially inward against the drum that a textile passing between the water bars and the drum is hydroentangled by the water jets;

an axially extending suction tube inside the drum and having respective radially outwardly open, angularly spaced, and axially extending suction openings aligned with the water bars for aspirating water therefrom through the drum; and respective seal means inside the suction tube at each of the suction openings movable between a closed position blocking liquid flow through the respective suction opening along its full axial length and an open position permitting such flow.

2. The machine according to claim 1 wherein the seal means can be actuated during operation of the machine.

3. The machine according to claim 1 wherein the seal means are each a mechanism provided in the material of walls that form the respective suction openings.

4. The machine according to claim 1 wherein the seal means each include a shutter that can be transversely moved over the respective suction opening.

5. The machine according to claim 4 wherein the shutter is coupled to one side of the suction opening at several locations distributed along a working length of the respective suction opening and supported such that it can be displaced parallel thereto.

6. The machine according to claim 4 wherein each shutter has an axis that extends parallel to the respective suction opening and the shutter is pivotally supported.

7. The machine according to claim 6 wherein the axes are each radially inward in the tube and the respective shutters extend radially outward therefrom.

8. The machine according to claim 6 wherein the axes are each arranged radially outward in the tube and the respective shutters extend radially inward therefrom.

9. The machine according to claim 1 wherein the seal means are each actuated pneumatically.

10. The machine according to claim 1 wherein the seal means are each actuated hydraulically.

11. The machine according to claim 9 wherein the seal means each have and are actuated by a respective inflatable hose extending along the suction opening.

12. The machine according to claim 11 wherein each seal means includes a shutter that can be moved in front of the respective suction opening by the hose.

13. The machine according to claim 11 wherein the seal means each include a hose on one side of the suction opening and inflatable against a supporting wall such that it extends across the respective suction opening in order to seal it.

14. The machine according to claim 3 wherein each seal means includes a respective sealing rail with a through-going slot extending along the respective suction opening in walls bounding the respective suction opening such that it can be laterally displaced back and forward, the slot being aligned in the open position with the suction respective opening or displaced and not aligned with the respective suction opening in the closed position.

15. The machine according to claim 14 wherein each seal means includes several pressure pistons along a length and to both sides of the respective sealing rail and supported in the walls of the suction opening.

* * * * *